United States Patent [19]

Gorin

[11] 4,134,826

[45] Jan. 16, 1979

[54] METHOD FOR PRODUCING HYDROCARBON FUELS FROM HEAVY POLYNUCLEAR HYDROCARBONS BY USE OF MOLTEN METAL HALIDE CATALYST

[75] Inventor: Everett Gorin, San Rafael, Calif.

[73] Assignee: Continental Oil Company, Stamford, Conn.

[21] Appl. No.: 847,996

[22] Filed: Nov. 2, 1977

[51] Int. Cl.[2] ..... C10G 11/08; C01G 9/04

[52] U.S. Cl. ..... 208/108; 208/10; 208/52 CT; 252/411 S; 252/439; 252/441; 252/477 R; 423/99; 423/DIG. 12

[58] Field of Search ..... 208/108, 10; 252/411 R, 252/411 S, 414

[56] References Cited

U.S. PATENT DOCUMENTS

| | | | |
|---|---|---|---|
| 3,355,376 | 11/1967 | Gorin et al. | 208/108 X |
| 3,629,159 | 12/1971 | Gorin et al. | 252/414 |
| 3,657,108 | 4/1972 | Kiovsky et al. | 208/10 |
| 3,663,452 | 5/1972 | Kiovsky et al. | 252/438 |
| 3,725,239 | 4/1973 | Kiovsky et al. | 208/10 |
| 3,790,468 | 2/1974 | Loth | 208/10 |
| 3,790,469 | 2/1974 | Loth et al. | 252/416 X |
| 3,824,178 | 7/1974 | Wald | 208/108 |
| 3,824,179 | 7/1974 | Kiovsky | 208/108 |
| 3,844,928 | 10/1974 | Geymer | 208/108 X |

*Primary Examiner*—Delbert E. Gantz
*Assistant Examiner*—G. E. Schmitkons
*Attorney, Agent, or Firm*—F. Lindsey Scott; William A. Mikesell, Jr.; D. Leigh Fowler, Jr.

[57] ABSTRACT

In a process for hydrocracking heavy polynuclear carbonaceous feedstocks to produce lighter hydrocarbon fuels by contacting the heavy feedstocks with hydrogen in the presence of a molten metal halide catalyst, thereafter separating at least a substantial portion of the carbonaceous material associated with the reaction mixture from the spent molten metal halide and thereafter regenerating the metal halide catalyst, an improvement comprising contacting the spent molten metal halide catalyst after removal of a major portion of the carbonaceous material therefrom with an additional quantity of hydrogen is disclosed.

4 Claims, 1 Drawing Figure

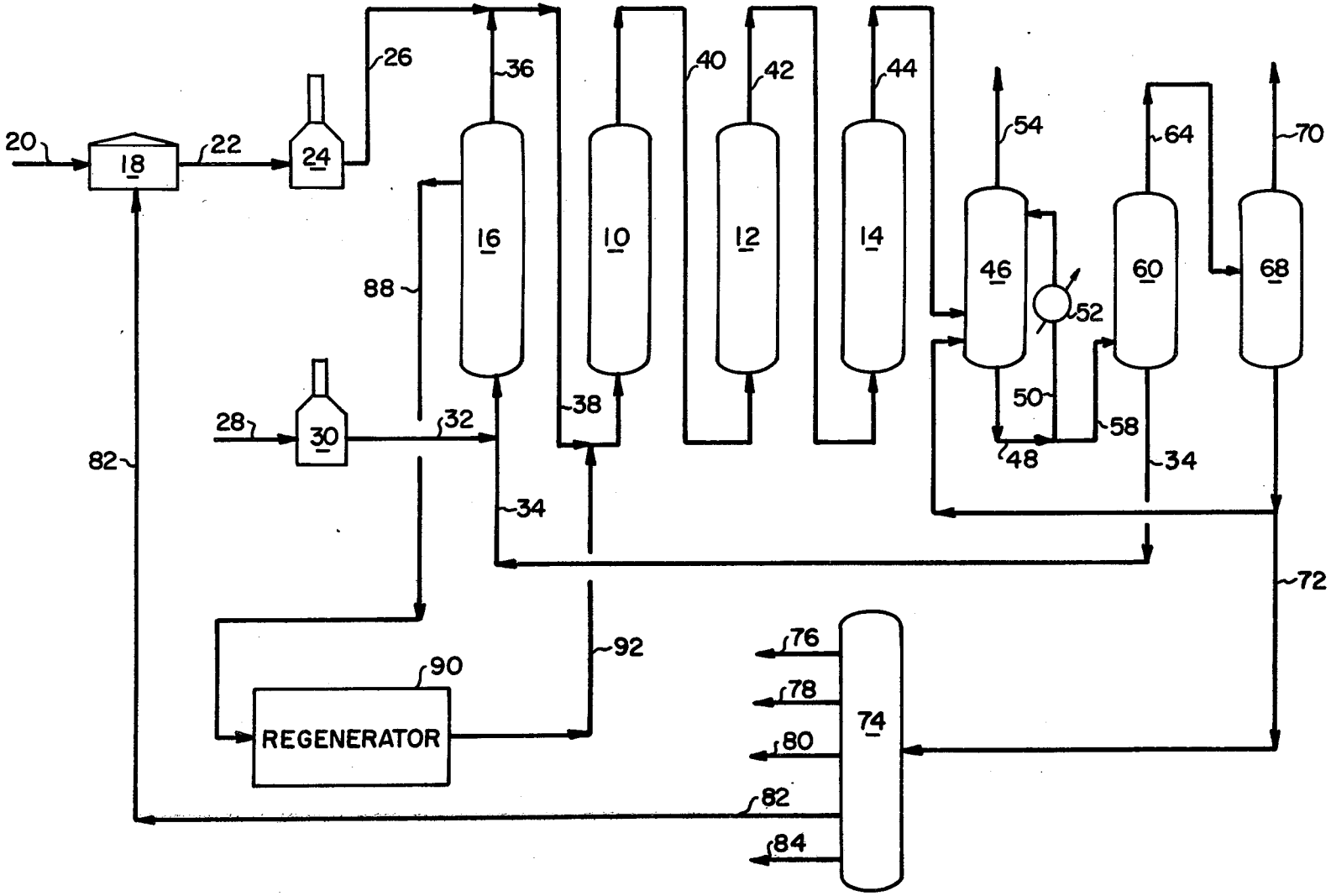
REGENERATOR

METHOD FOR PRODUCING HYDROCARBON FUELS FROM HEAVY POLYNUCLEAR HYDROCARBONS BY USE OF MOLTEN METAL HALIDE CATALYST

This invention resulted from work done pursuant to a contract with the U.S. Energy Research and Development Administration.

This application relates to the conversion of heavy aromatic polynuclear hydrocarbonaceous material into lower molecular weight hydrocarbon fuels by contacting such materials with hydrogen in the presence of a molten metal halide catalyst.

This invention further relates to an improvement in methods for hydrocracking heavy aromatic polynuclear hydrocarbonaceous materials by reacting such materials with hydrogen in the presence of a molten metal halide catalyst and thereafter recovering lower molecular weight hydrocarbon fuels from the reaction mixture whereby the spent molten metal halide from which a substantial quantity of the lower molecular weight hydrocarbons has been removed is contacted with additional hydrogen.

As a result of the continuing well-known shortage of petroleum products such as gasoline, diesel fuel, natural gas, and the like, a continuing effort has been directed to the development of alternative fuel sources which do not depend upon petroleum as a feedstock. In particular, a considerable amount of effort has been devoted in recent years to the development of processes which will produce liquid and gaseous hydrocarbon fuels from coal feedstocks. One such process is the reaction of heavy aromatic polynuclear carbonaceous material such as coal, coal extract, and the like with hydrogen in the presence of molten metal halide to produce gasoline-range materials and other lower molecular weight hydrocarbon fuels. One such process is shown for instance, in U.S. Pat. No. 3,355,376, issued Nov. 28, 1976 to Gorin et al. Some similar processes are shown in U.S. Pat. No. 3,371,049, issued Feb. 27, 1968 to Gorin et al.; U.S. Pat. No. 3,594,329, issued July 20, 1971 to Gorin et al.; U.S. Pat. No. 3,625,861, issued Dec. 7, 1971 to Gorin et al.; and U.S. Pat. No. 3,629,159, issued Dec. 21, 1971 to Gorin et al. These disclosures are hereby incorporated by reference. Such processes have utilized various metal halides with zinc chloride being preferred. In such processes, the lower molecular weight product hydrocarbons are normally recovered from the reaction zone either as a gaseous stream or in mixture with the spend molten metal halide. The mixture is subjected to flashing, distillation, solvent contacting, or the like to recover the product hydrocarbons from the spent molten metal halide. Even after such recovery, considerable amounts of the heavier product hydrocarbons remain with the spent molten metal halide and present problems in the regeneration of the metal halide and the like. Further, quantities of hydrocarbons which remain with the molten metal halide as passed to regeneration are lost as products. Desirably, at least a major portion of these heavier molecular weight hydrocarbon materials is recovered from the molten metal halide. Considerable effort has been directed to the development of methods whereby increased quantities of such heavier hydrocarbons can be so recovered.

It has now been discovered that such improved recovery can be accomplished by contacting the spent molten metal halide, from which a substantial quantity of the product hydrocarbons has been removed, with hydrogen.

The FIGURE is a schematic flowsheet of a process wherein the present invention is utilized.

In the FIGURE, a heavy aromatic polynuclear hydrocarbon feedstock is contacted with hydrogen in the presence of a molten metal halide catalyst in a first reactor 10, a second reactor 12, and a third reactor 14. A feedstock, such as coal, is introduced via a feed line 20 to a coal slurry preparation section 18 where it is desirably ground, dried, and the like, and slurried in oil prior to charging to first reactor 10. The feed is then passed through a line 22 to a heater 24 where it is heated to a desired temperature and then passed through a line 26 and a line 38 to first reactor 10. Hydrogen is supplied to the process through a line 28 via a heater 30 and a line 32. The hydrogen is mixed with the spent molten metal halide catalyst in line 34 and charged to a hydrogen-contacting vessel 16. The unreacted hydrogen and vapors and liquids produced in vessel 16 are recovered through line 36 and passed to the feedstream passing through line 38 to reactor 10. The combined stream passing through line 38 to reactor 10 contains the feedstock, hydrogen and the products recovered from vessel 16. The effluent from reactor 10 is passed to reactor 12 through a line 40 and then from reactor 12 to reactor 14 with the reaction effluent eventually passing from reactor 14 to an extractor vessel 46. The reaction effluent from line 44 is mixed with a recycle oil in extractor 46. Extractor 46 is equipped with a recycle loop comprising lines 48 and 50. Line 50 includes a heat exchanger 52 for cooling the recycled mixture. Desirably the mixture in extractor 46 is cooled to a temperature from about 600° to about 650° F. An overhead stream comprising hydrogen, light hydrocarbons and the like is recovered from extractor 46 via a line 54 and passed to gas purification (not shown). The stream recovered through line 54 may be recycled to reactor 10 after removal of sulfur compounds etc., the hydrogen content of the stream may be recovered and recycled and the like as known to those skilled in the art. The reaction effluent, after mixing with oil in extractor 46, is passed via line 48 and a line 58 to a settler 60 from which spent metal halide melt is recovered via a line 34. The spent melt is then passed to hydrogen contactor 16. A liquid stream is recovered from settler 60 via line 64 and passed to a flash drum 68. A gaseous stream comprising unreacted hydrogen, light hydrocarbons and the like is recovered from flash drum 68 through line 70 and, after purification, may be passed to methane and light hydrocarbon recovery, recycled to the hydrogen charge to the reactors or the like, as known to those skilled in the art. Liquid hydrocarbon products are recovered from flash drum 68 via a line 72 and passed to a fractionator 74 where the products are fractionated to produce various product streams 76, 78 and 80 such as light hydrocarbons, gasoline, kerosene, diesel fuel and the like, and a heavier distillate stream 82 (typically a 200 × 360° C. range oil) which is optionally recycled to section 18 for use in slurrying the coal. The recycled distillate is further hydrogenated and is eventually produced as gasoline-range products. A heavy fuel oil stream 84 is also produced and includes a major portion of the products which are resistant to further hydrogenation. This stream is desirably removed via line 84 as a heavy fuel product. The spent molten metal halide catalyst after hydrogen contacting in vessel 16, is recovered via a line 88 and passed to catalyst regeneration 90 from which regenerated metal halide catalyst is passed to reactor 10 via a line 92 which joins feed line 38 to reactor 10.

Desirably, the hydrogen and spent molten metal halide catalyst are mixed and passed to vessel 16 in such a way that the hydrogen functions as a stripping gas to remove additional quantitles of heavy hydrocarbonaceous material from the spent molten metal halide. Further, the hydrogen is present in reaction vessel 16 at a temperature and pressure such that additional hydrogenation of the spent melt is accomplished. Such use of hydrogen results in a synergistic improvement in the recovery of heavy carbonaceous materials from the spent melt since both a stripping action and a further hydrogenation under more severe conditions are simultaneously accomplished. The removal of a major portion of the hydrocarbon products from the spent melt prior to the hydrogen contacting step in vessel 16 permits an enhanced use of hydrogen in reacting with the more difficultly hydrogenated high molecular weight materials.

Desirably, reaction conditions is vessel 16 are a temperature from about 800° to about 1050° F., a pressure from about 1200 to about 6000 psia with a hydrogen partial pressure from about 1000 to about 5000 psia, and a residence time from about 5 to about 60 minutes.

Reaction conditions in reactors 10, 12 and 14 are normally from about 1200 to about 6000 psia, a temperature from about 700° to about 1050° F. and a hydrogen partial pressure from about 1000 to about 5000 psia. It is desirable that the reactor conditions increase somewhat in severity from reactor 10 to reactor 12, to reactor 14 etc., although clearly a variety of operating variations is possible as is known to those skilled in the art.

While processes with which the present invention is effective may use zinc chloride, zinc bromide, zinc iodide, antimony bromide, antimony iodide and the like as a catalyst, zinc chloride is most commonly used and is preferred. Various other metal salts may be used in the reaction mixture as shown, for instance in U.S. Pat. No. 3,736,250 issued May 29, 1973 to Berg, et al., and U.S. Pat. No. 3,764,515 issued Oct. 9, 1973 to Kiovsky. These disclosures are hereby incorporated by reference. While zinc chloride is the preferred metal halide, it is noted that the improvement of the present invention is effective with such processes generally.

It is also noted that the flowsheet shown is illustrative rather than limiting in nature and that many variations and modifications are possible. For instance, it is possible that a product stream could be recovered from each of reaction vessels 10, 12 and 14 with a hydrogen inlet to each of reaction vessels 10, 12 and 14. Such variations and modifications are well within the skill of those in the art and need not be discussed in detail, especially since many such variations are disclosed in the patents incorporated herein by reference.

The separation of the hydrocarbon materials from the spent molten metal halide catalyst may be accomplished by a variety of routes such as distillation, vacuum distillation, solvent extraction, decantation and the like. The improvement of the present invention is effective in removing residual quantities of heavy hydrocarbonaceous material from spent molten metal halide catalyst regardless of which of these methods is used although as indicated, it is highly desirable that at least a major portion of the hydrocarbonaceous material be removed from the spent melt prior to passing the spent melt to vessel 16 for further hydrogen contacting. Desirably, no feed streams other than the spent melt and hydrogen are passed to vessel 16 so that the full effects of the enhanced hydrogen treatment may be realized. In other words, it is desirable in order to take full advantage of the treatment with the hydrogen stream in vessel 16 that no new feed be charged to vessel 16 so that the stripping and further hydrogenation is accomplished by treatment with hydrogen in the absence of competing reactions with fresh feedstock and the like.

Having thus described the invention by reference to its preferred embodiments, it is pointed out that numerous variations and modifications are possible within the scope of the present invention. Many such variations and modifications may be considered obvious or desirable by those skilled in the art upon a review of the description of preferred embodiments.

Having thus described the invention, I claim:

1. In a process for hydrocracking heavy carbonaceous feedstocks to produce hydrocarbon fuels by contacting said feedstocks with hydrogen in the presence of a molten metal halide catalyst to produce said hydrocarbon fuels; thereafter separating at least a major portion of said hydrocarbon fuels from the spent molten metal halide catalyst and regenerating said catalyst, the improvement comprising passing said spent molten metal halide catalyst from which said major portion of said hydrocarbon fuels has been removed to a hydrogen contactor zone and contacting said spent molten metal halide in said hydrogen contactor with hydrogen.

2. The improvement of claim 1 wherein said spent molten metal halide is contacted with hydrogen at a pressure from about 1200 to about 6000 psia, a hydrogen partial pressure from about 1000 to about 5000 psia and a temperature from about 800° to about 1050° F.

3. The improvement of claim 2 wherein no feedstreams other than said spent molten metal halide and said hydrogen are present during said hydrogen contacting of said molten metal halide in said hydrogen contactor zone.

4. The improvement of claim 1 wherein said metal halide in zinc chloride.

* * * * *

UNITED STATES PATENT OFFICE
CERTIFICATE OF CORRECTION

PATENT NO. : 4,134,826
DATED : January 16, 1979
INVENTOR(S) : Everett Gorin

It is certified that error appears in the above-identified patent and that said Letters Patent are hereby corrected as shown below:

Col. 1, line 39: "Nov. 28, 1976" should read --Nov. 28, 1967--;

Col. 1, line 51: "spend" should read --spent--.

Signed and Sealed this
*Twenty-ninth* Day of *May 1979*

[SEAL]

*Attest:*

RUTH C. MASON
*Attesting Officer*

DONALD W. BANNER
*Commissioner of Patents and Trademarks*